United States Patent [19]

Bauer

[11] 3,949,179

[45] Apr. 6, 1976

[54] CONTROL DEVICE HAVING IMPROVED RESET MEANS

[75] Inventor: Werner R. Bauer, Radnor, Pa.

[73] Assignee: Robertshaw Controls Company, Richmond, Va.

[22] Filed: Dec. 16, 1974

[21] Appl. No.: 533,148

[52] U.S. Cl. ..... 200/83 R; 200/83 S; 200/328; 92/96

[51] Int. Cl.[2] ..... H01H 35/34

[58] Field of Search ..... 200/83 R, 83 J, 83 P, 83 S, 200/83 SA, 159 B, 318, 323, 324, 325, 328; 137/389, 390, 458, 461; 92/96

[56] References Cited

UNITED STATES PATENTS 3,875,359 4/1975 Backus ..... 200/83 S

FOREIGN PATENTS OR APPLICATIONS 609,746 9/1960 Italy ..... 200/328

1,225,262 9/1966 Germany ..... 200/328

*Primary Examiner*—Gerald P. Tolin

*Attorney, Agent, or Firm*—Candor, Candor & Tassone

[57] ABSTRACT

A control device having a condition responsive movable part and an electrical switch to be operated by that part, mechanical latch means operatively interconnecting the part to the switch to latch the switch in one operating position thereof when the condition is on one side of a certain value and to unlatch the switch so as to be in another operating position when the condition is on the other side of the certain value. The mechanical latch means includes reset means for resetting and latching the switch back to the one operating position thereof only when the condition is on the one side of the certain value thereof.

9 Claims, 8 Drawing Figures

CONTROL DEVICE HAVING IMPROVED RESET MEANS

This invention relates to an improved control device.

It is well known to provide a control device that has a condition responsive movable part operatively interconnected to an electrical switch to cause the switch to be in one operating position thereof when the condition being monitored is on one side of a certain value and to cause the switch to be in another operating position thereof when the condition is on the other side of that certain value. For example, such a control device can be pressured and/or temperature responsive whereby the electrical switch is closed only when the condition being monitored is either above or below a preselected value.

It is a feature of this invention to provide such a control device with latch means which will latch the switch in one of the operating positions thereof when the condition is on one side of a certain value and to unlatch the switch so as to be in another operating position thereof when the condition is on the other side of that certain value together with reset means for resetting and latching the switch back to the one operating position thereof only when the condition is on that one side of the certain value.

In particular, one embodiment of this invention provides a control device having a condition responsive movable part carried by a housing means and an electrical switch carried by the housing means to be operated by the movable part. Mechanical latch means are carried by the housing means and operatively interconnect the movable part to the switch to latch the switch in one operating position thereof when the condition is on one side of a certain value and to unlatch the switch so as to be in another operating position thereof when the condition is on the other side of that certain value. The mechanical latch means includes reset means for resetting and latching the switch back to the one operating position thereof only when the condition is on the one side of the certain value so that the electrical switch cannot be momentarily turned to an "on" position should an attempt be made to reset the control device when the condition being monitored is not on the one side of the certain value which would permit the switch to be closed.

Accordingly, it is an object of this invention to provide an improved control device having one or more of the novel features set forth above or hereinafter shown or described.

Other objects, uses and advantages of this invention are apparent from a reading of this description which proceeds with reference to the accompanying drawing forming a part thereof and wherein.

Figure 1:
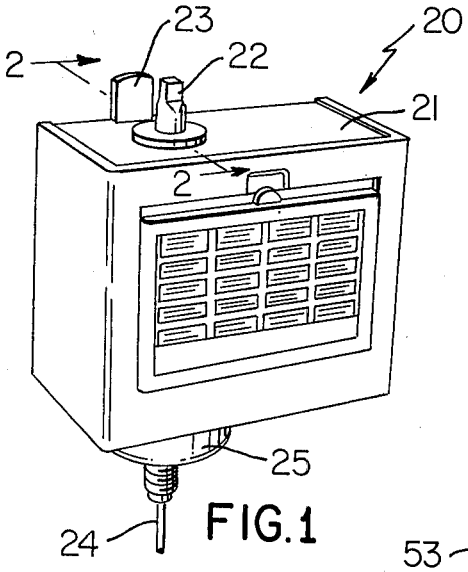
FIG. 1 is a perspective view of the improved control device of this invention.
Figure 3:
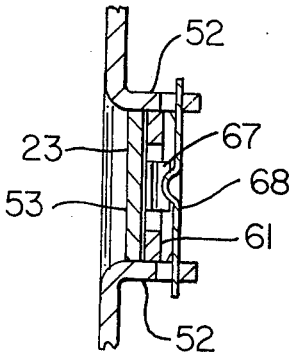
FIG. 3 is a fragmentary cross-sectional view taken on line 3—3 of FIG. 2.

While the various features of this invention are hereinafter described and illustrated as being particularly adapted to provide a pressure and/or temperature responsive control device, it is to be understood that the various features of this invention can be utilized singly or in any combination thereof to provide a control device responsive to other means as devised.

Therefore, this invention is not to be limited to only the embodiment illustrated in the drawings, because the drawings are merely utilized to illustrate one of the wide variety of uses of this invention.

Referring now to FIG. 1, the improved control device of this invention is generally indicated by the reference numeral 20 and comprises a housing 21 having a rotatable condition selector or adjustor 22 extending therefrom as well as an axially movable or slideable manual reset member or plunger 23. A capillary tube 24 also extends from the housing means 21 and is adapted to be interconnected to a pressure and/or temperature sensing bulb (not shown) in a manner well known in the art whereby the bulb can sense the condition in a particular room or other desired location which the control device 20 is to monitor.

Figure 4:
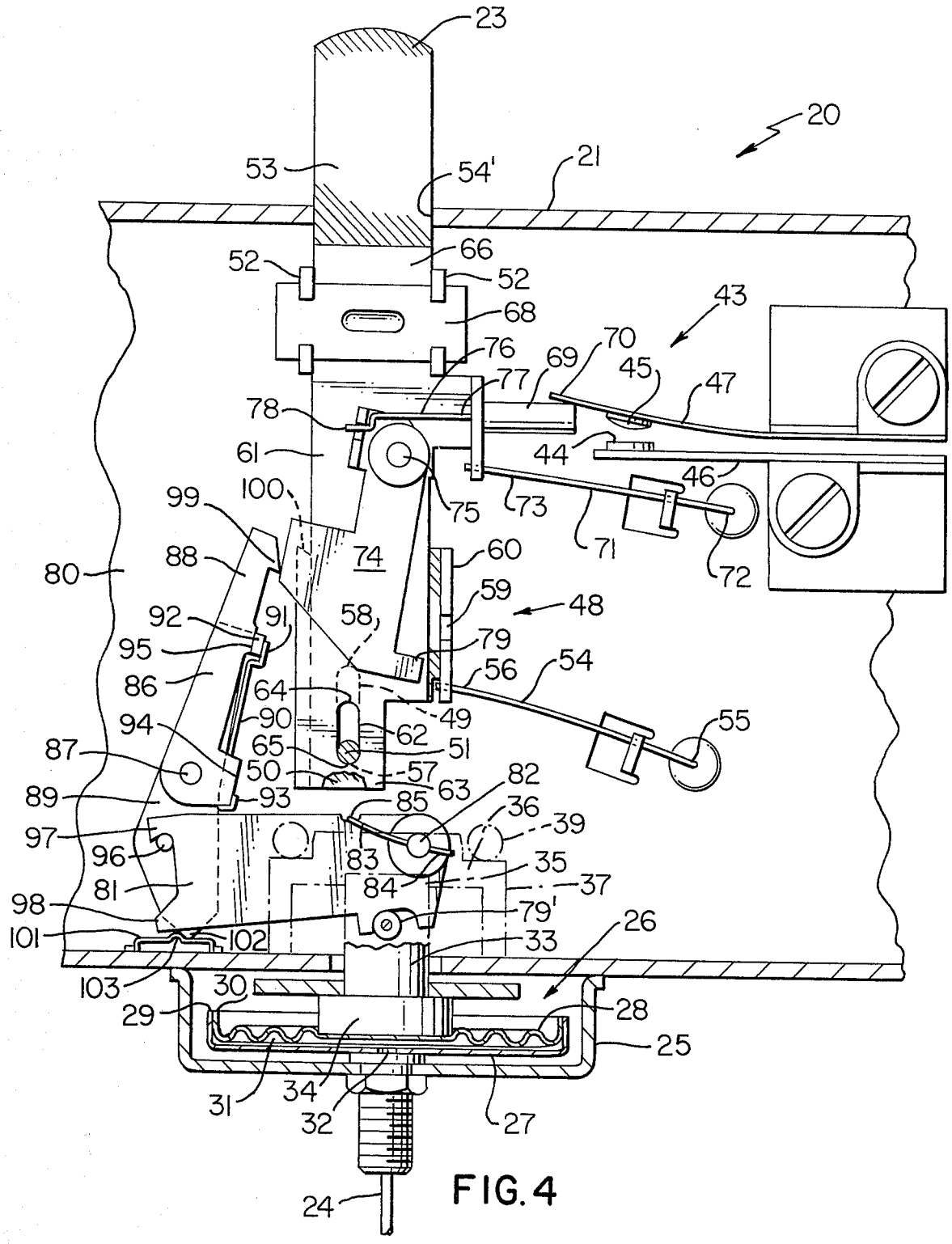
FIG. 4 is a fragmentary, cross-sectional view taken substantially on line 4—4 of FIG. 2 and illustrates the control device when the same is in an "off" condition thereof.

As illustrated in FIG. 4, the housing means 21 includes a cup shaped part 25 containing a condition responsive means that is generally indicated by the reference numeral 26 and comprises a fixed cup shaped wall 27 and a movable cup shaped wall 28 disposed in the fixed cup shaped wall 27. The walls 27 and 28 have their outer peripheries 29 and 30 secured and sealed together to define a chamber 31 therein that is interconnected to the capillary tube 24 through an opening 32 in the fixed wall 27 whereby the movable wall 28 moves relative to the fixed wall 27 upon a change in the volume of the chamber 21 caused by the expansion or contraction of a fluid medium in the pressure and/or temperature sensing bulb (not shown) in a manner well known in the art.

A plunger 33 has its lower end 34 disposed against the movable wall 28 and its upper end 35 bearing against a closed end 36 of a cup shaped member 37 whereby the cup shaped member 37 will move up and down in the housing means 21 in response to changes in the condition being sensed by the control device 20 in a manner hereinafter described.

Figure 2:
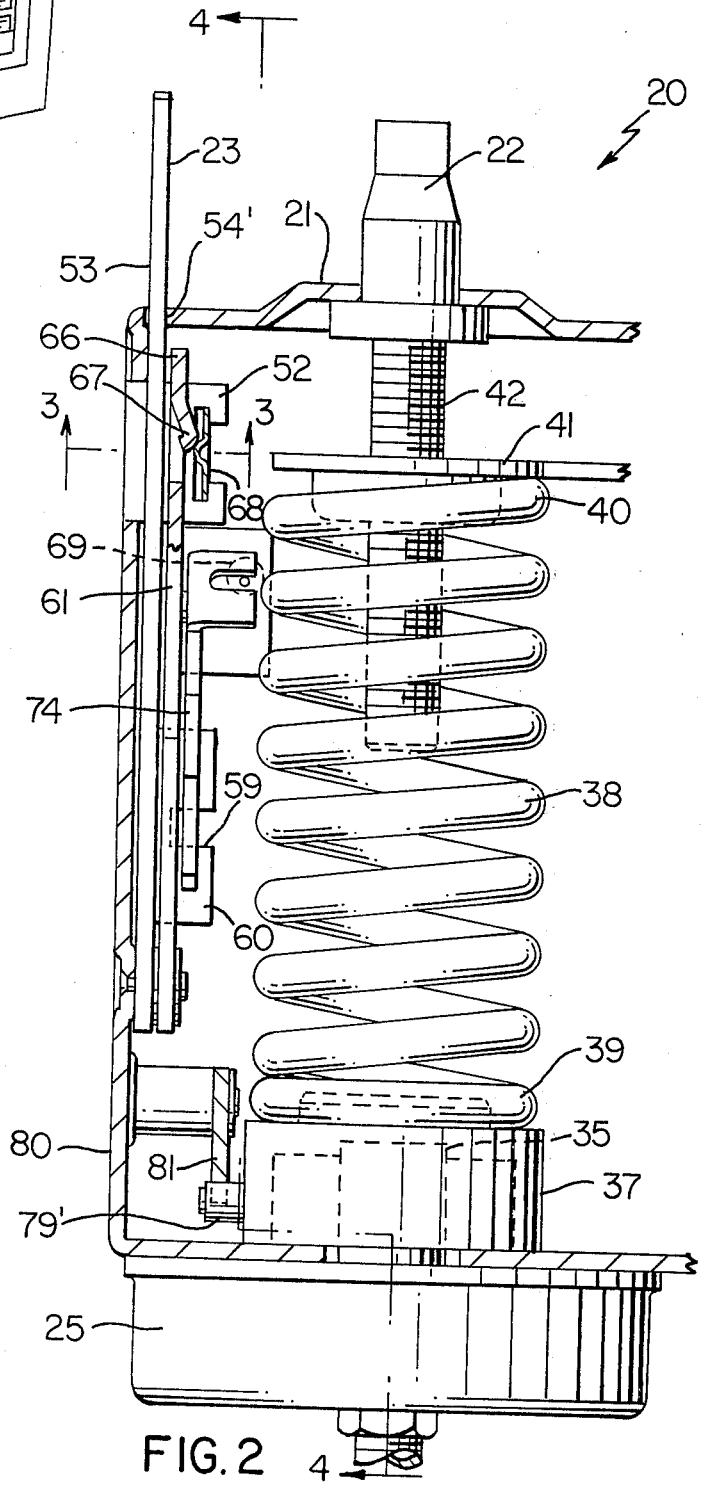
FIG. 2 is an enlarged, fragmentary, cross sectional view taken substantially on line 2—2 of FIG. 1.

A range spring 38 as illustrated in FIG. 2 has a lower end 39 which rests on the cup shaped member 37 and an upper end 40 which bears against a spring retainer 41 threaded on a threaded extension 42 of the rotatable selector or adjustor 22 so that when the adjustor 22 is rotated in a certain direction, the force of the range spring 38 opposing the upward movement of the movable wall 28 can be increased, rotation of the adjustor 22 in the opposite direction decreasing the compression force of the compression spring 38 acting downwardly on the wall 28 whereby the amount of force required for moving the movable wall 28 upwardly in the drawing to a certain position can be selected. For example, should the controller 20 be a temperature controller, the adjustor 22 can be set so that the control 20 will be "on" whenever the temperature being sensed by the condition responsive means 26 is above 70° F and the controller 20 will be "off" whenever the temperature is below 70° F whereby the selected value of the adjustor 22 becomes the certain value of the controller 20 as hereinafter set forth.

As previously stated, the control device 20 is so constructed and arranged that should the sensed condition be below the certain value which will turn "on" the control device 20, a person cannot utilize the manual reset means 20 in an attempt to turn on the control device 20 even momentarily as will be apparent hereinafter.

Figure 6:
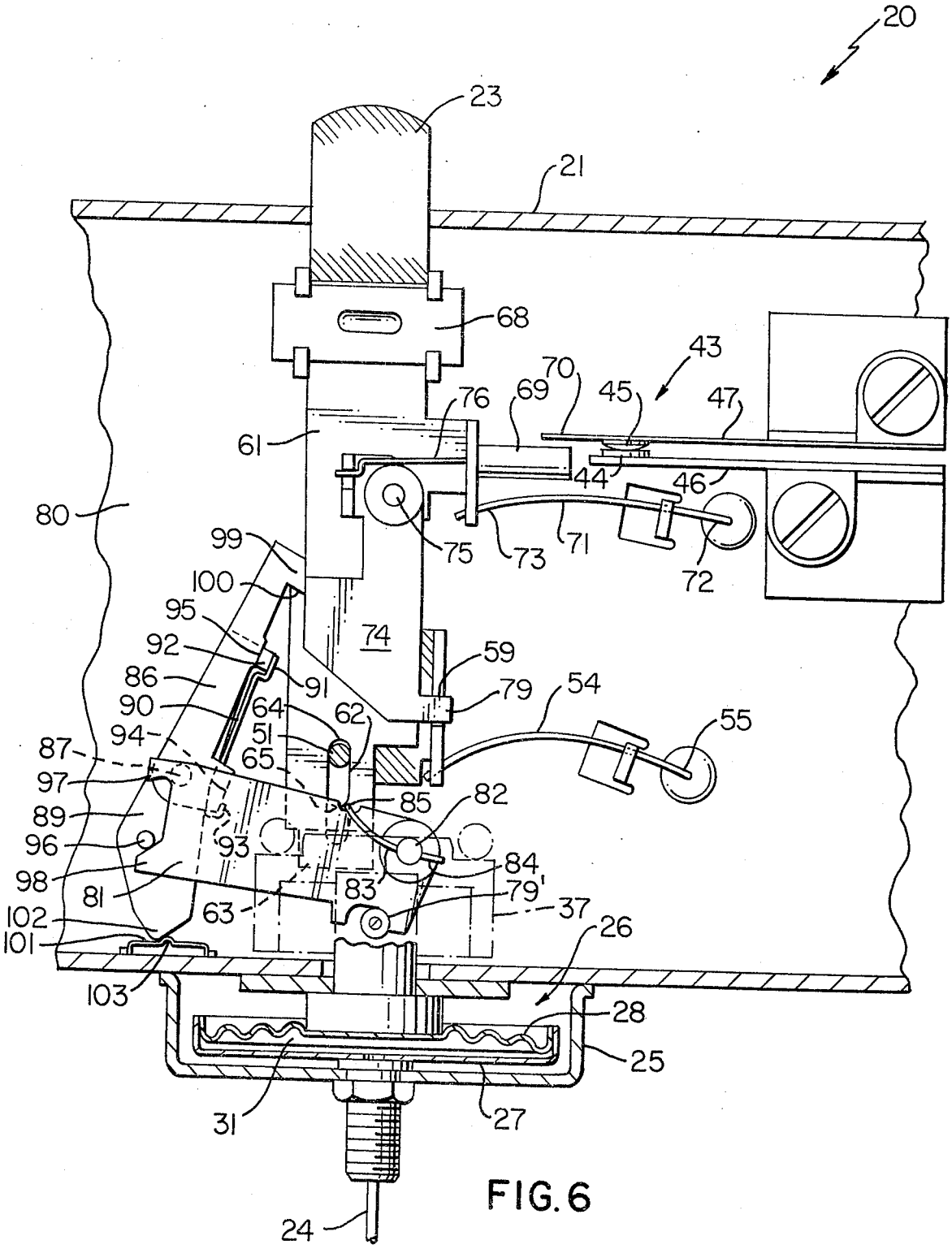
FIG. 6 is a view similar to FIG. 5 and illustrates the control device when reset in the "on" condition thereof.

As illustrated in FIG. 4, the housing means 21 contains an electrical switch that is generally indicated by the reference numeral 43 and comprises a fixed contact 44 and a movable contact 45, the fixed contact 44 being carried on a fixed blade 46 and the movable contact 45 being carried on a flexible switch blade 47 which has a normal bias to place the movable contact 45 in contact with the fixed contact 44 in the manner illustrated in FIG. 6 whereby the switch 43 is closed and the control device is "on" or is in an "on" condition for any desired purpose, such as operating an air conditioning system to tend to reduce the temperature of the space being monitored by the condition responsive means 26 back down to the desired selected value, which in the previously described example, was 70° F. However, should the temperature of the space being monitored by the condition responsive means 26 subsequently fall below 70° F, the control device 20 will cause the movable switch blade 47 to be moved to an open condition as illustrated in FIG. 4 to open the switch 43 and, thus, turn the control device 20 "off" or to an "off" condition thereof.

The means of this invention for operatively interconnecting the movable wall 28 of the condition responsive means 26 to the electrical switch 43 comprises mechanical latch means of the control device 20 that is generally indicated by the reference numeral 48 and which will now be described.

The mechanical latch means 48 includes the manually operated reset member or plunger 23 that has an elongated slot 49 formed in the lower end 50 thereof and having a fixed post 51 of the housing means 21 passing therethrough whereby up and down movement of the member 23 relative to the housing means 21 is guided by the post 51 as well as by a pair of outwardly bent tabs 52 of the housing means 21 and between which the upper part 53 of the member 23 passes before the same projects out through a guiding slot 54′ of the housing means 21 as illustrated in FIG. 4.

Figure 5:
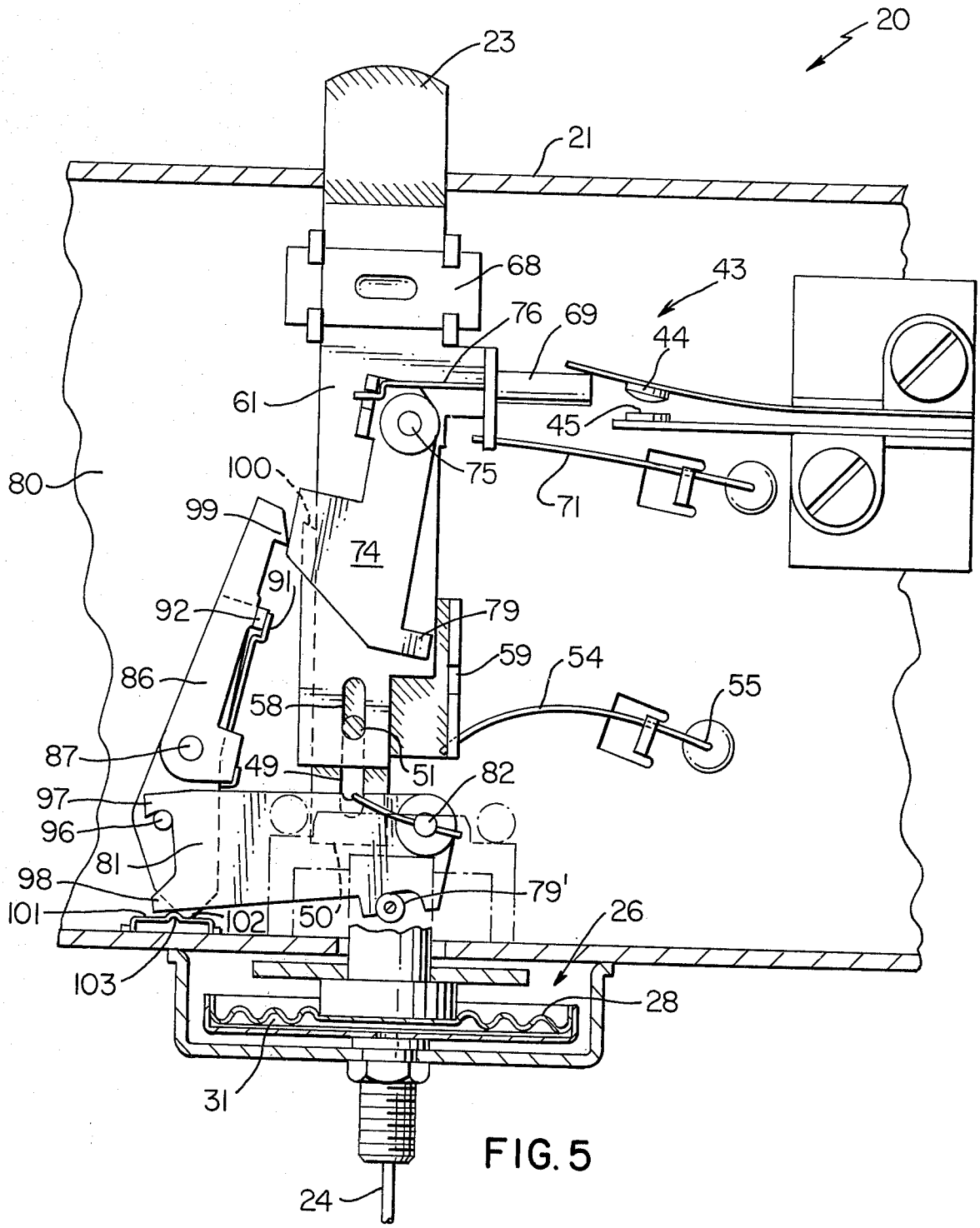
FIG. 5 is a view similar to FIG. 4 and illustrates the control device when an attempt is being made to reset the same and the condition being sensed is not at a value that permits resetting of the control device to an "on" condition thereof.

A spring member 54 has one end 55 fixed to the housing means 21 and the other end 56 attached to the reset member 23 with the bias of the spring 54 being such that the same tends to normally urge the member 23 to its full up position as illustrated in FIG. 4 where the lower end 57 of the elongated slot 49 of the member 23 abuts against the pin 51 to thereby limit the upward movement of the member 23 whereas downward movement of the member 23 in opposition to the force of the spring 54 is limited by the upper end 58 of the slot 49 engaging against the pin 51 as illustrated in FIG. 5 as will be apparent hereinafter.

The member 23 is provided with a latch receiving or keeper slot 59 formed in a right angle bent side 60 thereof for a purpose hereinafter described.

A switch control member 61 is substantially superimposed upon the reset member 23 while being movable relative thereto and has an elongated slot 62 in the lower end 63 thereof which also has the fixed rod 51 of the housing means 21 passing therethrough so as to guide up and down movement of the switch control member 61 within the limits of the top and bottom portions 64 and 65 of the slot 62 between the positions illustrated in FIGS. 4 and 6 for a purpose hereinafter described.

The switch control member 61 has its upper end 66 guided by the tangs 52 of the housing means 21 in the same manner as the upper end 53 of the reset member 23 while being provided with an outwardly carved and bent tongue 67 which is engageable with a detent projection or spring part 68 carried by the housing tangs 52 so that in order to move the switch control member 61 from the up position illustrated in FIG. 2 to a down position illustrated in FIG. 6, the tongue 67 has to be snapped past the detent 68 and thus prevent a slow motion closing of the switch 43 during a manual reset operation as will be apparent hereinafter.

The switch control member 61 has a plunger part 69 which is adapted to engage against the free end 70 of the flexible switch blade 47 to move and hold the switch blade 47 out of contact with the fixed contact 44 in the manner illustrated in FIG. 4 when the switch control member 61 is permitted to be moved to its "up" position by the force of a spring member 71 that has one end 72 thereof fixed to the housing means 21 and the other end 73 thereof fixed to the switch control member 61 to normally tend to move the same upwardly to the "up" position illustrated in FIG. 4 where the bottom 65 of the slot 62 engages against the fixed pin 51 as illustrated whereby the switch 43 is in an "off" condition thereof. However, when the switch control member 61 is moved downwardly and held or latched in the "down" position illustrated in FIG. 6 in a manner hereinafter described, the plunger 69 is free of the free end 70 of the switch blade 47 so that the movable contact 45 is normally held in a closed condition against the fixed contact 44 to close the switch 43 and cause the control device 20 to be in its "on" condition.

A locking element 74 is pivotally mounted to the switch control member 61 by a pivot post 75 carried by the switch control member 61 and about which the locking element 74 swings or rotates. A spring member 76 has one end 77 carried by the switch control member 61 and the other end 78 thereof attached to the locking element 74 to tend to normally cause the locking element 74 to rotate in a clockwise direction in FIG. 4 to thereby tend to hold a projection or tang 79 of the locking element 74 out of the keeper or slot 59 of the reset member 23 as will be apparent hereinafter.

The cup shaped spring retainer 37 has a roller-like projection 79′ extending from the side thereof and facing toward the rear wall 80 of the housing means 21. The roller 79′ engages against a lever 81 pivotally mounted to the rear wall 80 of the housing means 21 by a pivot post means 82, the lever 81 normally being biased in a counterclockwise direction in FIG. 4 by a spring member 83 having one end 84 carried by the post means 82 and the other end 85 bearing against the lever 81. However, when the movable wall 28 of the condition responsive means 26 moves upwardly in FIG. 4 to a certain position as illustrated in FIG. 6 wherein the condition being sensed by the condition responsive means 26 is above the previously described certain value, the roller 79' has cammed the lever 81 in a clockwise direction in opposition to the force of the spring 83 to operate another locking element 86 that is pivotally mounted to the rear wall 80 of the housing means 21 by a pivot post means 87.

The locking element 86 comprises two parts 88 and 89 both pivotally mounted on post means 87 and normally moving in unison by the action of a spring member 90 having one end 91 fastened to a tang 92 of the lever part 89 and having the other end 93 thereof bearing against an edge 94 of the lever part 88 to normally tend to cause another part 95 thereof to engage against the tang 92 of the first part 89.

The part 89 of the locking element 86 has a pin 96 extending therefrom and against which a pair of spaced cam tangs 97 and 98 of the lever 81 is to operate so that when the lever 81 is moved in a clockwise direction by the condition responsive means 26 from the position illustrated in FIG. 4 to the position illustrated in FIG. 6, the cam part 98 of the lever 81 has acted on the post 96 of the locking element 86 to tend to cause the locking element 86 to pivot in a clockwise direction about the post 87 so that the upper end 99 of the locking element 86 will not only engage against the first-mentioned locking element 74 and tend to move the same in a counterclockwise direction about its pivot post 75 for a purpose hereinafter described, but will also be moved to a position to lock against a locking shoulder 100 of the switch control member 61 in a manner hereinafter described to lock or latch the switch 43 in the closed position as illustrated in FIG. 6 for a purpose hereinafter described.

Conversely, when the lever 81 is moved counterclockwise by the spring 83 from the position illustrated in FIG. 6 back to the position illustrated in FIG. 4, the cam part 97 operates on the pin 96 of the locking element 86 to cause the locking element 86 to be moved in a counterclockwise direction about its pivot 87 and thereby move the end 99 of the locking element 86 to the left and thereby permit the locking element 74 to be moved in a clockwise direction by its spring 76 as well as clear the end 99 out of the path of the locking shoulder 100 of the switch control member 61 whereby the switch control member 61 can be moved upwardly by its spring 54 to move the switch 43 to its "open" position.

The two previously described positions of the locking element 86 are controlled by a detent 101 that is carried by the housing means 21 and operates on a lower end 102 of the locking element 86 whereby the locking element 86 is either disposed on one side or the other of the projecting portion 103 of the detent 101 as will be apparent hereinafter.

Therefore, it can be seen that the various parts of the mechanical latch means 48 of this invention for operatively interconnecting the movable wall 28 of the condition responsive means 26 to the electrical switch 43 for operating the same are relatively simple in structure and in the assembly thereof to operate in an effective manner now to be described.

Assuming that the control device 20 is in the "off" condition illustrated in FIG. 4 where the switch 43 is in its "off" condition and the condition being sensed by the condition responsive means 26 is below the certain value that has been pre-selected by the adjustor 22 through the range spring 38 so that the movable wall 28 of the condition responsive means 26 is maintaining the lever 81 in the "down" position illustrated in FIG. 4 and thereby holding the locking element 86 to the left whereby the locking element 74 is being held by its spring 76 so that the tang 79 is out of the path of the keeper 59 of the manual reset means 23 as illustrated in FIG. 4, the operator may come along and decide to try to reset the control device 20 to its "on" condition, not knowing that the condition value is still below the certain value setting of the adjustor 22 whereby the operator will push downwardly on the manual reset member 23 in the manner illustrated in FIG. 5. However, the electrical switch 43 will still remain in the unlatched "off" condition thereof because the reset member 23 will be pushed downwardly until the top part 58 of its elongated slot 49 in the lower end 50 thereof bottoms out against the rod 51. The switch control member 61 will remain in its "up" position by its spring 71 because the locking element 74 does not lock the switch control member 61 to the manual reset member 23 unless the condition being sensed by the condition responsive means 26 is above the preset certain value.

Thus, it can be seen that when the condition being sensed by the condition responsive means 26 is below the certain value setting of the adjustor 22 of the control device 20, the control device 20 can not be reset to latch the switch 23 in its "on" condition.

Figure 4A:
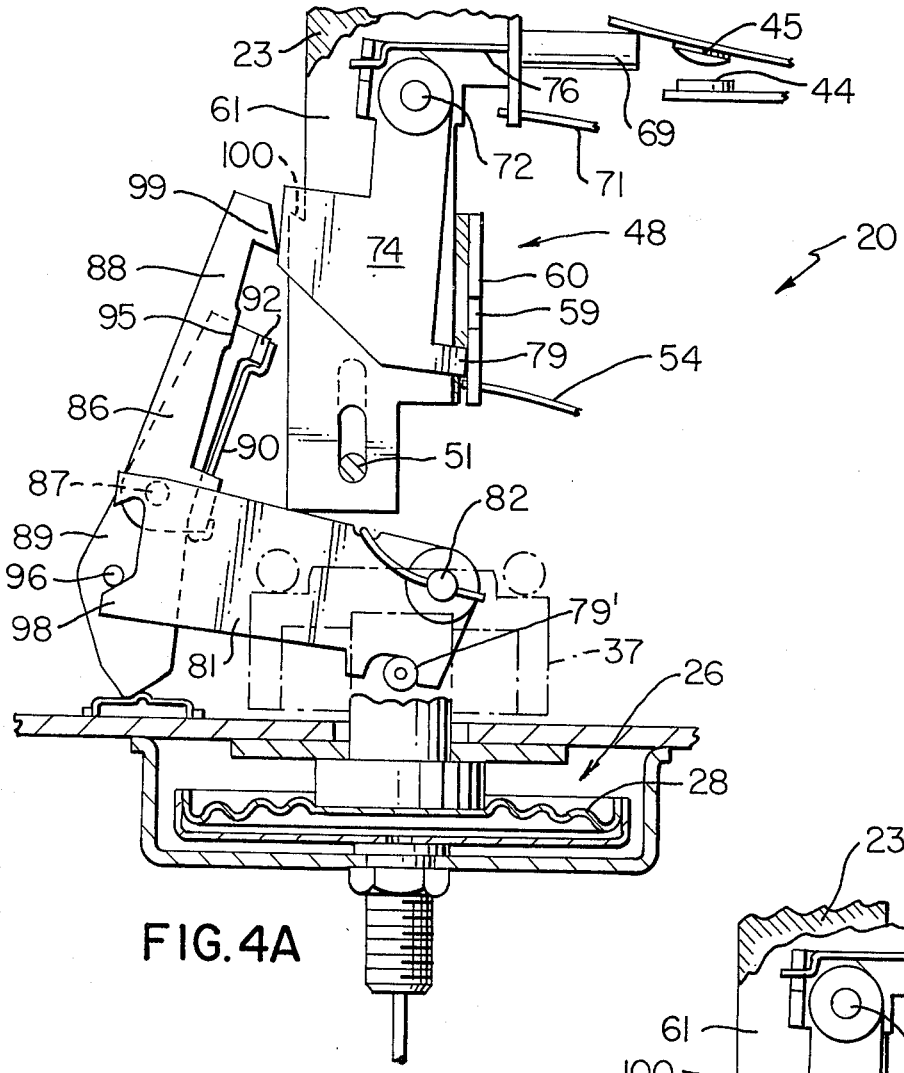
FIG. 4A is a fragmentary view similar to FIG. 4 and illustrates the initial movement of the manual reset means when the control device is in a condition to be reset.

However, when the condition being sensed is above the certain value as illustrated in FIG. 4A, the same has moved the cup shaped member 37 upwardly in opposition to the force of the range spring 38 to such a position that the roller 79 thereof has pivoted the lever 81 in a clockwise direction about the pivot point 82 to have the cam tang 98 thereof operate on the post 96 of the locking element 86 and thereby pivot the locking element 86 about the pivot pin 87. The locking element 86 now pivots in a clockwise direction whereby the end 99 thereof acts against the locking element 74 and moves the same in a counterclockwise direction until the tongue 79 thereof engages against the bent plate 60 of the manual reset member 23 as illustrated in FIG. 4A whereby further movement of the locking element 74 in a counterclockwise direction is prevented. Thus, the split locking element 86 causes the part 89 thereof to continue to move in a clockwise direction and the spring 90 stores energy therein to eventually move the part 88 further in a clockwise direction as will be apparent in connection with FIG. 4B.

Figure 4B:
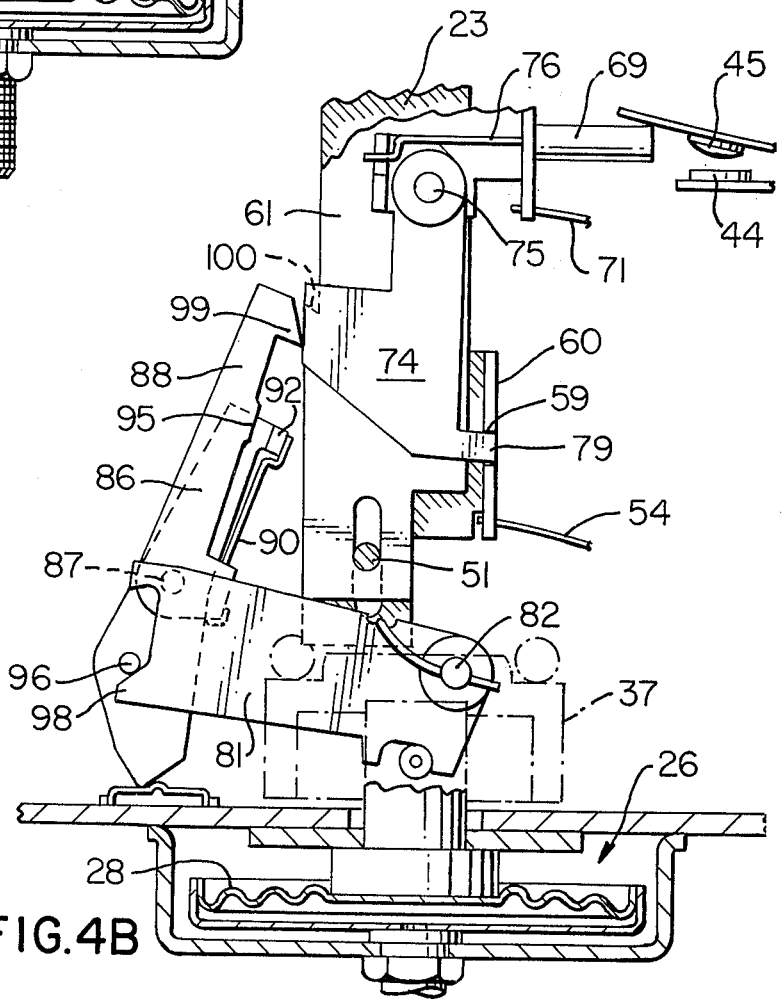
FIG. 4B is a view similar to 4A and illustrates further movement of the manual reset means from the position illustrated in FIG. 4A.

Thus, the parts remain in the position illustrated in FIG. 4A when the condition reaches the certain value until the operator begins to push downwardly on the reset member 23 in the manner illustrated in FIG. 4B so that when the keeper or slot 59 in the plate 60 of the downwardly moving reset member 23 aligns itself with the tongue 79 of the locking element 74, the stored energy in the spring 90 causes the part 88 of the locking element 86 to move further in a clockwise direction about the pivot point 87 in the manner illustrated in 4B to move the tongue 79 of the locking element 74 into the slot 59 whereby the locking element 74 now locks the reset member 23 and switch control member 61 together. Accordingly, further movement of the reset member 23 downwardly with the parts 23 and 61 now being locked together by the locking element 74 as illustrated in FIG. 6 causes the switch control member 61 to move downwardly therewith to such a position that the end 99 of the part 88 of the locking element 86 can be further moved in a clockwise direction to be disposed over the locking edge 100 of the switch control member 61 to lock the same in the "down" position illustrated in FIG. 6 where the plunger 69 has been moved downwardly to permit the switch blade 47 to close the movable contact 45 against the fixed contact 44 and thereby close the switch 43 and place the control device 20 in its "on" position.

Thus, the parts of the control device 20 remain latched in the position illustrated in FIG. 6 where the switch 43 is in its closed position and the control device 20 is in its "on" condition until the condition being sensed by the condition responsive means 26 falls below the certain value setting of the control device 20. At this time, the movement of the movable wall 28 downwardly to the position illustrated in FIG. 4 causes the lever 81 through its spring 83 to move in a counterclockwise direction until its cam tongue 97 cams against the post 96 of the locking element 86 and causes the same to rotate in a counterclockwise direction to thereby pull its end 99 away from the locking edge 100 of the switch control member 61 as well as away from the locking element 74 so that the locking element 74 can move in a clockwise direction and move its tongue 79 out of the keeper slot 59 of the manually operated reset member 23. At this time, the two springs 71 and 54 respectively drive the switch control member 61 and reset member 23 upwardly to the position illustrated in FIG. 4 where the bottoms 65 and 57 of the respective slots 62 and 49 of the members 61 and 23 engage against the rod 51 limiting such upward movement. However, the plunger 69 of the switch control member 61 has moved the switch blade 47 upwardly to open the switch 43 as illustrated in FIG. 4.

The control device 20 now remains in the unlatched condition illustrated in FIG. 4 with the switch 43 in its "off" condition. The switch 43 cannot be reset to its "on" condition until the condition being sensed by the condition responsive means 26 comes up to the certain value setting of the adjustment member 22 for the reasons previously described in connection with the attempted reset action of the member 23 in FIG. 5.

However, when the condition responsive means 26 is sensing a condition above the certain value setting of the adjustment member 22 in the manner illustrated in FIG. 4A, the control device 20 can be reset by the operator manually moving the reset member 23 downwardly as illustrated in FIGS. 4B and 6. As the reset member 23 is being moved downwardly as illustrated in FIG. 4B to pick up the switch control member 61 by having the locking element 74 lock its tongue 79 into the keeper slot 59 of the reset member 23 as illustrated in FIG. 4B, it takes a certain amount of force on the reset member 23 to further move the same downwardly and thereby cause the tongue 67 on the switch control member 61 to snap past the detent 68 of the housing means 21 thereby ensuring a certain rapid further movement of the reset member 23 and locked switch control member 61 downwardly so that the switch 43 is rapidly closed rather than slowly closed whereby no adverse "frying" of the contacts 45 and 44 takes place during the reset closing of the switch 43.

Of course, when the locking element 86 is unlocked from its latching position illustrated in FIG. 6, the force of the spring 71 is such that the same drives the switch control element member 61 upwardly with a rapid action so that the switch 43 is opened with a rapid movement to prevent any contact "frying" thereof.

While the control device 20 has been illustrated and described as opening the switch 43 when the sensed condition is above a certain value, the same could be made to open the switch 43 when the sensed condition is below a certain value by changing the lever 81 so that the surfaces of the tangs 97 and 98 slope in the opposite direction to cause the locking element 86 to pivot in a clockwise direction when the tang 97 engages the post 96 and to pivot in a counterclockwise direction when the tang 98 engages the post 96.

Therefore, it can be seen that this invention not only provides an improved control device having improved reset means therefor, but also this invention provides an improved method of making such a control device or the like.

While the form of this invention now preferred had been described and illustrated as required by the Patent Statute, it is to be understood that other forms can be utilized and still come within the scope of the appended claims.

What is claimed is:

1. In a control device having a condition responsive movable part carried by a housing means and an electrical switch carried by said housing means to be operated by said part, the improvement comprising mechanical latch means carried by said housing means and operatively interconnecting said part to said switch to latch said switch to be in one operating position thereof when said condition is on one side of a certain value and to unlatch said switch so as to be in another operating position thereof when said condition is on the other side of said certain value, said mechanical latch means including reset means for resetting and latching said switch to said one operating position thereof only when said condition is on said one side of said certain value and said switch is in said other operating position, said mechanical latch means including a plunger member defining part of said reset means and a switch actuating member, said members having locking means to lock said members together to move together in a switch resetting direction only when said condition is on said one side of said certain value, one of said locking means being movable relative to the other locking means and being out of locking engagement with said other locking means when said condition is on said other side of said certain value and being moved into locking engagement with said other locking means when said condition is on said one side of said certain value.

2. In a control device as set forth in claim 1, said switch normally being in said other position thereof and said switch actuating member moving said switch to said one position thereof when said switch actuating member is moved to a resetting position thereof by said plunger member being moved to a resetting position thereof.

3. In a control device as set forth in claim 2, said locking means of said members comprising a movable locking element carried by one of said members and a keeper carried by the other of said members to receive said locking element and thereby lock said members together whereby said locking element comprises said one locking means and said keeper comprises said other locking means.

4. In a control device as set forth in claim 3, said mechanical latch means including means for moving said locking element to a locking position thereof only when said condition is on said one side of said certain value.

5. In a control device as set forth in claim 4, said means for moving said locking element also locking said switch actuating member in said switch latching position thereof when said switch actuating member is moved by said plunger member to said reset position thereof when said condition is on said one side of said certain value.

6. In a control device as set forth in claim 5, said means for moving said locking element comprising another locking element that is operatively interconnected to said part to be moved to a locking position thereof only when said condition is on said one side of said certain value.

7. In a control device as set forth in claim 6, said switch actuating member having a part thereof to be engaged by said other locking element to be locked thereby in said switch latching position thereof.

8. In a control device as set forth in claim 1, said condition responsive part comprising a fluid pressure responsive wall.

9. In a control device as set forth in claim 8, said device having an adjustable range spring operatively associated with said fluid pressure responsive wall whereby said certain value can be selectively changed.

* * * * *